US006397921B1

(12) United States Patent
Wartenbergh

(10) Patent No.: US 6,397,921 B1
(45) Date of Patent: Jun. 4, 2002

(54) ROLLER SCREEN

(75) Inventor: Leonardus Hendrikus Wartenbergh, Gouda (NL)

(73) Assignee: Hamstra International B.V., Weesp (NL)

( * ) Notice: Subject to any disclaimer, the term of this patent is extended or adjusted under 35 U.S.C. 154(b) by 0 days.

(21) Appl. No.: 09/506,352

(22) Filed: Feb. 17, 2000

(30) Foreign Application Priority Data

Jan. 14, 2000 (NL) ..... 1014061

(51) Int. Cl.[7] ..... A47G 5/02
(52) U.S. Cl. ..... 160/267.1; 160/266; 160/273.1
(58) Field of Search ..... 160/266, 267.1, 160/268.1, 270, 272, 273.1

(56) References Cited

U.S. PATENT DOCUMENTS 1,764,880 A * 6/1930 Nelson ..... 160/267.1
1,766,730 A * 6/1930 Traut ..... 160/267.1
1,783,152 A * 11/1930 Oldham ..... 160/267.1 X
1,978,120 A * 10/1934 Watson ..... 160/267.1
2,491,765 A * 12/1949 Rambo ..... 160/267.1
4,399,855 A * 8/1983 Volfson ..... 160/271 X
4,458,739 A * 7/1984 Murray et al. ..... 160/269 X
5,839,493 A * 11/1998 Quasius ..... 160/273.1 X
5,950,253 A * 9/1999 Last ..... 160/273.1 X
5,964,270 A * 10/1999 Kirkey et al. ..... 160/273.1
5,964,271 A * 10/1999 Lapointe ..... 160/273.1
6,092,581 A * 7/2000 Andersson ..... 160/266 X

* cited by examiner

*Primary Examiner*—Bruce A. Lev
(74) *Attorney, Agent, or Firm*—Steven M. Koehler, Esq.; Westman, Champlin & Kelly, P.A.

(57) ABSTRACT

What is disclosed is a roller screen intended for being mounted on the frame of a window opening, a door opening or the like, which roller screen comprises a gauze screen, a roll-up mechanism for said gauze screen, which is accommodated in a housing, a pull beam connected to the free end of said gauze screen, and guides for guiding said pull beam and the side edges of said gauze screen. The guides each consist of a substantially cylindrical outer housing, which can be fixed to the frame, and a likewise substantially cylindrical inner housing, which is accommodated in said outer housing in such manner as to be concentrically rotatable therein. The outer housing and the inner housing are each provided with a longitudinal slot which extends substantially along their entire length, wherein the longitudinal slots of the outer housing and that of the inner housing overlap, seen in their circumferential direction, in an operative position of the roller screen.

21 Claims, 2 Drawing Sheets

ROLLER SCREEN

The invention relates to a roller screen intended for being mounted on the frame of a window opening, a door opening or the like, which roller screen comprises a gauze screen, a roll-up mechanism for said gauze screen, which is accommodated in a housing, a pull beam connected to the free end of said gauze screen, and guides for guiding said pull beam and the side edges of said gauze screen.

When a roller screen is to be mounted on a frame it is important that the guides take up a specific position with respect to the plane in which the gauze screen is moved to and fro. More in particular such guides generally include a slot, in which the pull beam and the side edges of the gauze screen are movable. Such a slot must be positioned to coincide with said plane.

Prior art guides have at least one flat outer side, which is placed in abutment with the frame in question upon being mounted. Thus the position (and in particular the spatial orientation) of the prior art guide is fixed, that is, said position is determined by the local shape of the frame in question. This may lead to mounting problems, however. For example, when the respective part of the frame does not extend fully horizontally or vertically, the spatial orientation imparted to the guide will be incorrect and its slot will not coincide with be inclined at an angle to said plane of the gauze screen. Moreover, mounting of the guide will be difficult when the frame includes a receding or projecting part. Usually it is necessary to revert to makeshift measures in the above cases, such as the use of fillers or fitting pieces, in order to fix the guide to the frame in a desired manner.

It is an object of the present invention to provide a solution for the above problems.

In order to accomplish that objective, the roller screen according to the invention is characterized in that said guides each consist of a substantially cylindrical outer housing, which can be fixed to the frame, and a likewise substantially cylindrical inner housing, which is accommodated in said outer housing in such manner as to be concentrically rotatable therein, which outer housing and which inner housing are each provided with a longitudinal slot which extends substantially along their entire length, wherein the longitudinal slots of the outer housing and that of the inner housing overlap, seen in their circumferential direction, in an operative position of the roller screen.

Regardless of the spatial orientation in which the outer housing is fixed due to the local shape of the frame, the inner housing, by rotating relative to the outer housing, is capable of taking up a position which ensures an optimum guidance of the pull beam and the side edges of the gauze screen in the overlapping longitudinal slots. When the guides are being mounted on the frame, the inner housing is on the one hand rotated relative to the outer housing and the outer housing is on the other hand moved relative to the frame prior to final fixation, all this in such a manner that the longitudinal slots of the outer housing and the inner housing lie substantially in the plane in which the gauze screen of the roller screen is moved to and fro. After such adjustment has taken place, the outer housing is fixed to the frame in any known manner (screws, bolts, glueing or the like).

The aspects as proposed make it possible to fix the guides to frames having different shapes in a quick and simple manner.

In one preferred embodiment of the roller screen according to the invention, the longitudinal slot of the outer housing is wider than the longitudinal slot of the inner housing, and the inner housing consists of a resilient material, at least adjacently to its longitudinal slot.

This enables the side edges of the gauze screen, which are generally provided with thickened guide cams, to move out of the guides when a large force is accidentally exerted on the gauze screen (for example when a person is unaware of the fact that a door opening is closed by the gauze screen and bumps into the gauze screen). Since the longitudinal slot of the outer housing is wider than the longitudinal slot of the inner housing, the resilient material of the inner housing is capable of bending outwards so as to provide room for the passage of the guide cams on the side edges of the gauze screen.

In this connection it is furthermore preferable that the longitudinal slot of the outer housing extends beyond the two sides of the longitudinal slot of the inner housing, seen in circumferential direction.

In principle it would suffice for the wider longitudinal slot of the outer housing to extend only beyond one side of the narrower longitudinal slot of the inner housing (in which case the slot edges of the two longitudinal slots will substantially coincide on one side). In that case only one longitudinal edge of the longitudinal slot could bend aside. In accordance with the present embodiment, however, it has been decided to form the longitudinal slot of the outer housing with a greater width on both sides of the narrower longitudinal slot (of the inner housing). This configuration enables the two longitudinal edges of the narrower longitudinal slot of the inner housing to move apart so as to release one edge of the gauze screen, if this should be necessary.

In accordance with another embodiment, in order to further enhance the mobility of the parts of the inner housing adjacent to the longitudinal slot, the inner wall of the outer housing is spaced from the outer wall of the inner housing by some distance adjacently to its longitudinal slot. Consequently, the outer housing and the inner housing do not abut against each other at that location, but a gap is present between the two housings, so that a larger part of the inner housing is available to enable a spring movement.

Furthermore the inner housing may have a substantially cylindrical inner wall, seen in sectional view, comprising two opposing recesses for guiding the pull beam, which recesses are disposed at equal angular distances from the longitudinal slot. The substantially cylindrical inner wall functions to guide the side edges of the gauze screen (and usually, as already noted before, the guide cams formed thereon). Accommodated in said recesses is a correspondingly shaped end of the pull beam. In this manner the pull beam can be prevented from being pulled out of the guides already before the side edges of the gauze screen have become detached therefrom.

As already noted before, the outer housing is fixed to the frame in question when the roller screen is being mounted. In this connection it may be advantageous for the outer housing to comprise a projecting mounting leg. Said mounting leg can be fixed to the frame by suitable fastening means (for example screws).

In a preferred embodiment the mounting leg extends substantially in radial direction with respect to the outer housing in that case. Such a position of the mounting leg provides a very universal mounting possibility.

Furthermore it may be advantageous to use an auxiliary section between the mounting leg and the frame, in particular when a sill projects beyond the front side of the frame and the guide is to be mounted on the sill.

The inner housing may consist of plastic material. The outer housing may be made of a metal such as aluminium, for example.

Finally it is preferable to use securing means for fixing the relative positions of the outer housing and the inner housing. Such securing means may be screw taps which are capable of engaging the outer side of the inner housing.

The invention furthermore relates to a guide intended for use in a roller screen according to the invention. Such a guide may already be used when the roller screen is first mounted , but it is also conceivable to exchange the original guide of an existing roller screen for the guide according to the invention.

The invention will now be explained in more detail with reference to the drawing, which shows a number of embodiments of the roller screen according to the invention. In the drawings.

Figure 1:
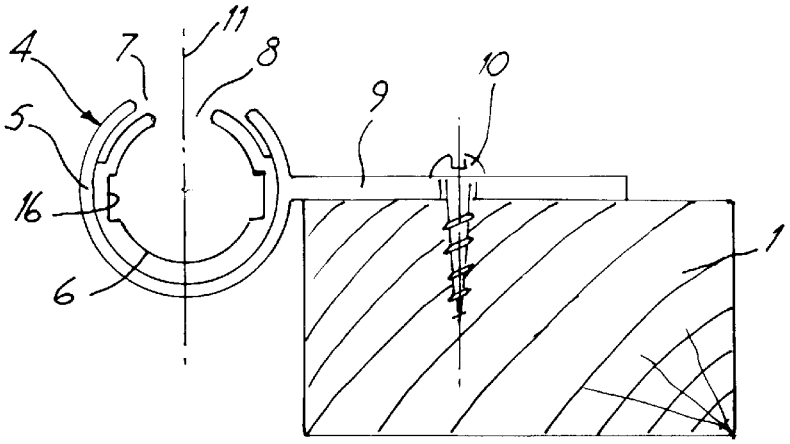
FIG. 1 is a sectional view of a part of a first embodiment of the roller screen according to the invention.
Figure 4:
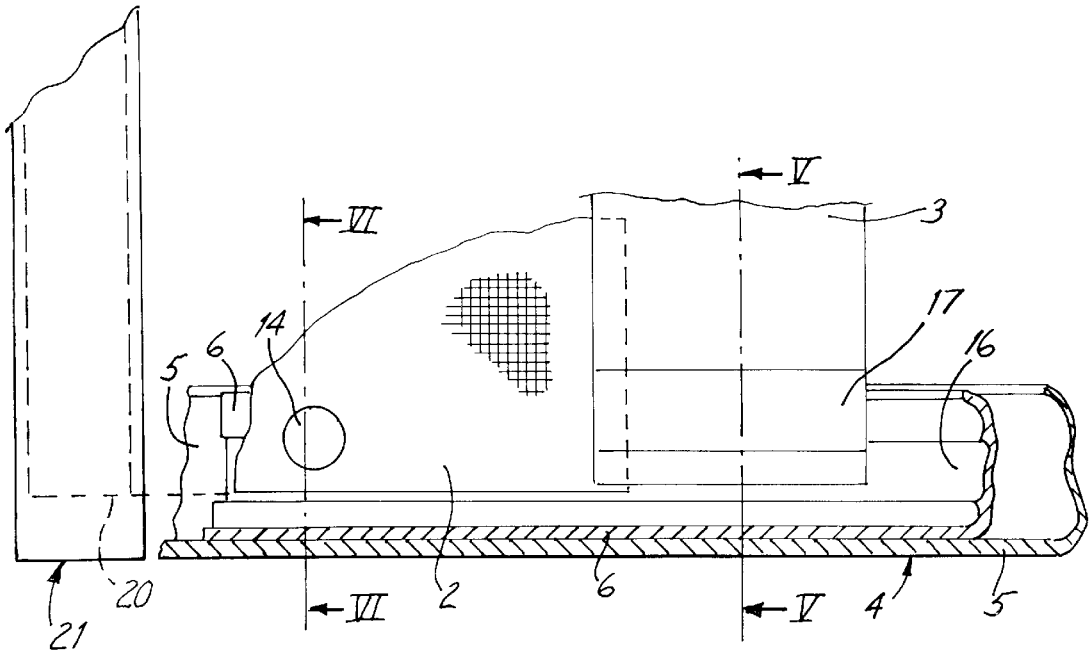
FIG. 4 is a schematic longitudinal sectional view of a part of an embodiment of the roller screen according to the invention.
Figure 5:
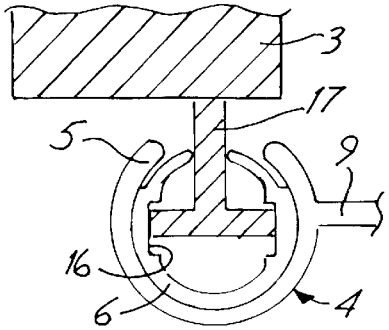
FIG. 5 is a sectional view according to V—V in FIG. 4.

FIG. 1 shows a flat sill 1 of a window opening, a door opening or the like, on which a roller screen according to the invention is to be mounted. Generally, such a roller screen consists of a gauze screen 2 (see FIGS. 4 and 6), a roll-up mechanism for the gauze screen (not shown), which is accommodated in said housing, a pull beam 3 connected to the free end of gauze screen 2 (see FIGS. 4 and 5), and guides 4 for guiding the pull beam and the side edges of the gauze screen. One of said guides may be fixed to a sill, for example, whilst the other may be fixed to an upper frame member (but it is also possible to fix the guides to opposing vertical frame members or the like).

As is apparent from the figures, each guide consists of a substantially cylindrical outer housing 5 and an inner housing 6, likewise cylindrical, which is accommodated therein. Outer housing 5 and inner housing 6 are concentrically rotatable relative to each other.

The outer housing includes a longitudinal slot 7, which extends substantially along the entire length thereof, whilst the inner housing is similarly provided with a longitudinal 8, which extends substantially along the entire length thereof.

Outer housing 5 also includes a mounting leg 9, which extends substantially radially with respect thereto. Said mounting leg can be used to secure the outer housing to sill 1 or the like, using screws 10. Of course it is also possible to use other fastening means, such as bolts, glue or the like, instead of screws 10.

Figure 2:
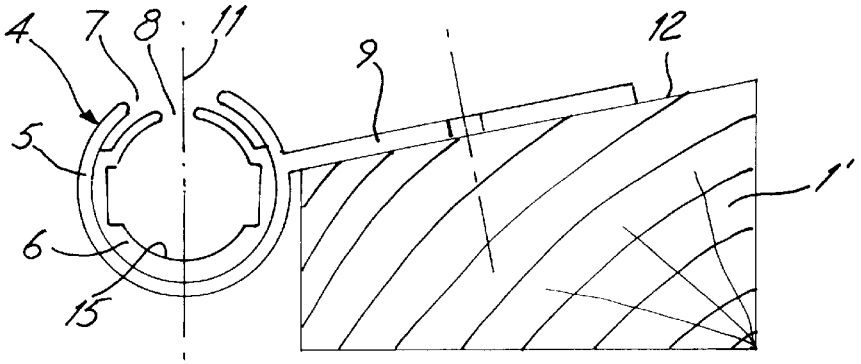
FIG. 2 is view corresponding to FIG. 1, wherein a second embodiment is shown.

Due to the fact that inner housing 6 is capable of rotation with respect to outer housing 6, longitudinal slot 8 can coincide at all times with the plane (schematically indicated by a chain-dotted line 11) in which the gauze screen 2 of the roller screen is moved to and fro. An example of this is shown in FIG. 2, wherein a sill 1' having an inclined top side 12 is shown. Compared to the position which is shown in FIG. 1, the inner housing 6 has been rotated in clockwise direction with respect to outer housing 5 in FIG. 2. In order to prevent longitudinal slot 8 of inner housing 6 from being covered (completely or partially) by outer housing 5 as a result of such rotation, the longitudinal slot 7 of outer housing 5 has been made wider than the longitudinal slot 8 of inner housing 6. As a result of this, longitudinal slots 7 and 8 will overlap at all times, seen in their circumferential direction, in an operative position of the roller screen.

Figure 3:
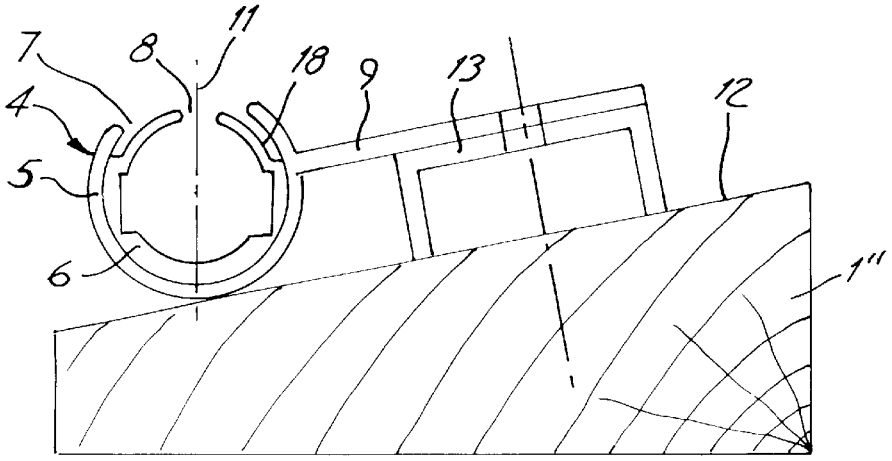
FIG. 3 is a view corresponding to FIG. 1, wherein a third embodiment is shown.

In the embodiments which are shown in FIGS. 1 and 2, guide 4 is disposed outside of sill 1 and 1', respectively. This is for example possible with a frame wherein none of the frame parts (and in particular the sill) projects beyond the other frame parts. If sill 1" projects on the front, however, as shown in FIG. 3, guide 4 must be mounted on sill 1" (otherwise a proper abutment between gauze screen 2 and the other frame parts would not be ensured). To this end an auxiliary section 13 is placed between mounting leg 9 and upper surface 12 of sill 1". Such an auxiliary section 13 can also be used with a sill having a horizontal top side, of course.

If guide 4 would comprise a tangentially projecting mounting leg, the auxiliary section 13 would not be necessary in the embodiment which is shown in FIG. 3. Furthermore it is conceivable to bend the end of the mounting leg in the situation as shown in FIG. 3, thus forming an "auxiliary section", as it were. In order to facilitate said bending, the mounting leg may include desired bending locations formed by weakened spots in the material in such as case.

The side edges of gauze screen 2 are retained by means of guides 4. This can for example be achieved by providing said side edges of the gauze screen 2 with guide cams 14 (see FIGS. 4 and 6). Furthermore a guide function is to be performed with respect to pull beam 6. In the illustrated embodiment the inner housing 6 is to that end provided with a substantially cylindrical inner wall 15, seen in sectional view, which includes two opposing recesses 16, which are disposed at substantially equal angular distances from longitudinal slot 8. A T-shaped end 17 (see FIGS. 4 and 5) of the pull beam 3 engages in said recesses 16.

Inner housing 6 is made of a resilient material, at least directly adjacent to its longitudinal slot 8. Furthermore a gap 18 is present between inner housing 6 and outer housing 5 at that location (see FIG. 6). In this manner the inner housing 6 is capable of bending outwards (to the position which is illustrated in dotted lines in FIG. 6) at the location of longitudinal slot 8, thus enabling guide cam 14 to move out. This is important in a situation wherein a large force is accidentally exerted on gauze screen 2 (for example when a person is unaware of the fact that a door opening is closed by a gauze screen). Thus gauze screen 2, guide cams 14 or guides 4 are prevented from being damaged.

Preferably, the inner housing consists entirely or partially of plastic material, such as a plastic having a low coefficient of friction. Outer housing 5 may be made of a metal, such as aluminium.

Figure 6:
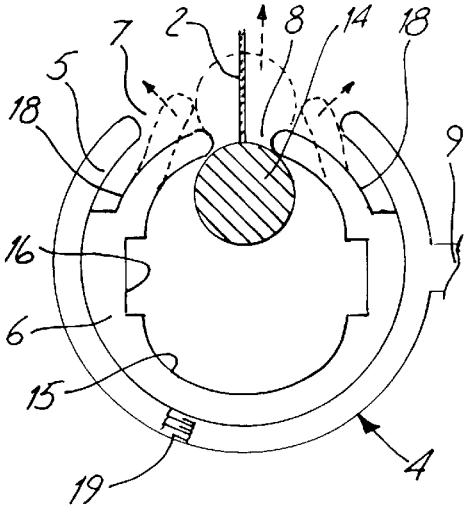
FIG. 6 is a larger-scale sectional view according to VI—VI in FIG. 4.

FIG. 6 shows a screw tap 19, which functions to fix the relative positions of outer housing 5 and inner housing 6.

The invention is not restricted to the above-described embodiment as shown in the drawing, which can be varied in several ways without departing from the scope of the claims. Thus, an auxiliary sections 13 which may be used may have many different forms. When inner housing 6 is to exhibit the above-described spring action, the presence of a gap 18 between inner housing 6 and outer housing 5 is furthermore not required. A satisfactory spring action can also be obtained in that longitudinal slot 7 in outer housing 5 is wider (seen in circumferential direction) than longitudinal slot 8 in inner housing 6 to a sufficient extent. Furthermore inner housing 6 need not be made of a resilient material as a whole in that case, but it will suffice when the part adjoining said longitudinal slot 8 is made of such a resilient material. Finally it is noted that although the invention has been described by means of a roller screen comprising a roll-up mechanism accommodated in a housing, the inventive idea of the invention equally applies to a roller screen which does not comprises a roll-up mechanism or a housing therefor.

What is claimed is:

1. A screen assembly intended for being mounted on the frame of an opening, which roller screen comprises:

a gauze screen;

a pull beam connected to a free end of said gauze screen; and guides for holding said pull beam and the side edges of said gauze screen, wherein said guides each include an outer housing having a substantially cylindrical chamber, the outer housing being fixable to the frame, and a likewise substantially cylindrical inner housing, which is accommodated in said cylindrical chamber in such manner as to be concentrically rotatable therein, which outer housing and which inner housing are each provided with a longitudinal slot which extends substantially along their entire length, the longitudinal slot of the outer housing being wider than the longitudinal slot of the inner housing and wherein the longitudinal slots of the outer housing and that of the inner housing overlap, in a circumferential direction thereof, in an operative position of the roller screen such that the inner housing can be rotated at least 15° in relation to the outer housing from a position where one set of proximate edges of the longitudinal slots of the inner and outer housings coincide to a position where the other set of proximate edges of the inner and outer housings coincides, while maintaining an overlap of the longitudinal slots of the inner and outer housings.

2. The screen assembly according to claim 1, wherein the inner housing comprises a resilient material, at least proximate the longitudinal slot of the inner housing.

3. The screen assembly according to claim 2, wherein the longitudinal slot of the outer housing extends beyond the two sides edges of the longitudinal slot of the inner housing in the circumferential direction.

4. The screen assembly according to claim 2, wherein an inner wall of the outer housing is spaced from an outer wall of the inner housing proximate the longitudinal slot of the outer housing.

5. The screen assembly according to claim 2, wherein the inner housing has a substantially cylindrical inner wall, comprising two opposing recesses for guiding the pull beam, which recesses are disposed at equal angular distances from the longitudinal slot.

6. The screen assembly according to claim 1, wherein the outer housing comprises a projecting mounting leg.

7. The screen assembly according to claim 6, wherein said mounting leg extends substantially in a radial direction with respect to the outer housing.

8. The screen assembly according to claim 6, wherein said mounting leg includes bending sections formed by weakened spots in the material.

9. The screen assembly according to claim 6, and further comprising an auxiliary section mountable to the mounting leg.

10. The screen assembly according to claim 1, wherein the inner housing is made of plastic material.

11. The screen assembly according to claim 1, wherein the outer housing is made of a metal.

12. The screen assembly according to claim 1, and further comprising securing means for fixing the relative positions of the outer housing and the inner housing.

13. The screen assembly according to claim 12, wherein said securing means comprise a set screw extending through the outer housing and engaging the inner housing.

14. The screen assembly according to claim 1 wherein the gauze screen includes cams each having a size wider than a width of the longitudinal slot of the inner housing, the cams being locatable in the inner housing.

15. The screen assembly according to claim 1 wherein the longitudinal slot of the inner housing has a constant width along the length thereof, allowing the gauze screen to be slid relative to the inner housing.

16. The screen assembly according to claim 1 and further comprising a roll-up mechanism for the gauze screen.

17. A screen assembly intended to be mounted on the frame of an opening, which screen assembly comprises:

an outer housing having a longitudinal cylindrical chamber with an outer longitudinal slot;

an inner housing having an outer cylindrical surface that is received in the longitudinal cylindrical chamber to be concentrically rotatable therein, the inner housing having an inner longitudinal slot such that the inner housing can be rotated at least 15° in relation to the outer housing from a position where one set of proximate edges of the longitudinal slots of the inner and outer housings coincide to a position where the other set of proximate edges of the inner and outer housings coincides, while maintaining an overlap of the longitudinal slots of the inner and outer housings; and a gauze screen with edges extending into the inner housing through the inner longitudinal slot and the outer longitudinal slot, the edges having enlarged end members to retain the edges of the gauze screen in the inner housing.

18. The screen assembly of claim 17 wherein the outer longitudinal slot is wider than the inner longitudinal slot.

19. The screen assembly of claim 18 wherein the inner longitudinal slot has a constant width along the length thereof, allowing the gauze screen to be slid relative to the inner housing.

20. The screen assembly of claim 19 and further comprising a pull beam connected to an end of the gauze screen, the pull beam being slidably guided in the inner housing.

21. The screen assembly of claim 18 wherein the inner housing comprises a resilient material at least proximate the inner longitudinal slot to allow passage of the enlarged end members.

* * * * *